US005762833A

United States Patent [19]

Gross et al.

[11] Patent Number: 5,762,833

[45] Date of Patent: Jun. 9, 1998

[54] AERATOR WITH A REMOVABLE STATOR AND METHOD OF REPAIRING THE SAME

[75] Inventors: Peter S. Gross, Plymouth; Weselley E. Slaymaker, Minneapolis, both of Minn.

[73] Assignee: Aeromix Systems, Inc., Minneapolis, Minn.

[21] Appl. No.: 708,799

[22] Filed: Sep. 9, 1996

[51] Int. Cl.[6] ..... B01F 3/04

[52] U.S. Cl. ..... 261/93; 415/224.5; 415/208.3

[58] Field of Search ..... 261/93; 415/224.5, 415/208.3, 189

[56] References Cited

U.S. PATENT DOCUMENTS

| | | | |
|---|---|---|---|
| 2,042,550 | 6/1936 | Putter | 415/208.3 |
| 2,084,863 | 6/1937 | Moss | 415/208.3 |
| 2,332,875 | 10/1943 | Stratton | 415/208.3 |
| 2,772,863 | 12/1956 | Harney et al. | 261/93 |
| 2,966,266 | 12/1960 | Coke | 261/93 |
| 3,333,762 | 8/1967 | Vrana | 415/224.5 |
| 3,791,104 | 2/1974 | Clitheroe | 261/93 |
| 3,813,086 | 5/1974 | Ebner et al. | 261/93 |
| 3,823,923 | 7/1974 | Chapsal . | |
| 3,891,729 | 6/1975 | Ebner et al. | 261/93 |
| 3,909,157 | 9/1975 | Wachtell et al. | 415/208.3 |
| 4,242,289 | 12/1980 | Blum | 261/93 |
| 4,265,739 | 5/1981 | Dalton | 261/93 |
| 5,145,317 | 9/1992 | Brasz | 415/208.3 |
| 5,332,534 | 7/1994 | Ebner | 261/87 |
| 5,356,570 | 10/1994 | Golob et al. | 261/93 |
| 5,458,816 | 10/1995 | Ebner et al. | 261/64.1 |

*Primary Examiner*—Tim R. Miles
*Attorney, Agent, or Firm*—Kinney & Lange, P.A.

[57] ABSTRACT

An improved aerator, including a removable stator, is disclosed. The aerator includes a submersible motor having a drive shaft which rotates an attached impeller within an aeration zone. The aeration zone includes the removable stator, an upper ring to which the submersible motor is attached and a lower ring. The removable stator engages the upper ring and the lower ring, and is configured to be readily removed from the aeration zone.

18 Claims, 5 Drawing Sheets

AERATOR WITH A REMOVABLE STATOR AND METHOD OF REPAIRING THE SAME

BACKGROUND OF THE INVENTION

The present invention relates to an improved aeration device. More particularly, it relates to an aerator having a removable stator.

Aeration is a widely used technique for treating, oxidizing and/or mixing a number of different fluids. For example, aeration is used to revitalize stagnant bodies of water (such as ponds) with a fresh supply of air and thus oxygen. Similarly, municipal wastewater treatment facilities utilize aeration to continuously oxygenate and treat wastewater. Other applications, such as wine and beverage manufacturing, dairy, and food and meat processing plants, all utilize aeration to either mix or maintain the fluid in question. In many instances, the fluid will contain solids.

Aeration or fluid mixing can be accomplished with different devices. These include forced air pumps and independent mixers. However, stand alone aeration devices, or aerators, are most often used and present several advantages. Submersible aerators are a type of stand alone aerator which inject oxygen into the fluid in addition to mixing. Because submersible aerators mix and aerate from the bottom of the fluid, a more thorough mixing and oxygenation is provided.

Normally, the fluid to be aerated is maintained within a single, tank-like structure or basin. This "basin" can range from a fabricated holding tank to a small body of water in which the recessed land forms a holding area. Regardless of form, the fluid to be aerated is accessible at a top surface but inaccessible at the bottom. To provide thorough aeration in a deep basin, the aerator must be located at the bottom of the basin. Then, when air is injected into the fluid, it will flow from the bottom of the fluid to the top, providing a more complete aeration effect.

Submersible aerators have assumed a relatively standard form. Basically, a submersible aerator includes a submersible motor having a drive shaft which rotates an impeller. The submersible motor is attached to a base section which includes an aeration zone within which the impeller rotates. More specifically, the base section includes a stator assembly which is permanently affixed to the base section. The stator assembly includes a plurality of channels, arranged in a variety of configurations, to which diffuser tubes are permanently attached. The base section also includes an inlet duct which directs air to the aeration zone. An air supply pipe is attached to the inlet duct, providing a source of air for aeration.

During normal operations, the aerator is lowered onto the floor of the basin. The actual depth of the fluid to be aerated will have previously been measured and the air supply pipe sized accordingly. In other words, the air supply pipe must be long enough so that a top portion is above the top surface of the fluid. Once in place, the submersible motor rotates the impeller within the stator assembly. The aerator aspirates atmospheric air down the air supply pipe by creating a low pressure area within the aeration zone, at the impeller. The impeller normally includes a plurality of angled vanes which forcibly combine air, supplied via the inlet duct, with the fluid. The combination of fluid and air is then forced into the stator channels. The diffuser tubes receive the liquid/air mixture from the stator channels and inject it into the fluid. Preferably, the air is propelled into the fluid in the form of fine bubbles which maximize oxygen transfer efficiency. The bubbles rapidly move from the diffuser tubes to the top surface, causing further mixing of air and fluid to occur.

As described in the previous paragraph, the aerator transfers oxygen into the fluid. Additionally, the aerator acts to mix the fluid, both by the propelled bubbles and by the impeller itself. In other words, rapid rotation of the impeller draws surrounding fluid into the aeration zone. Where the fluid contains solid material, commonly found with wastewater or sludge applications, the impeller grinds and cuts the solids against an inner wall of the stator assembly, providing additional contact between bacteria, oxygen and waste material.

Aerators have achieved a great deal of success in oxygenizing and mixing fluids with air. Use of a rotating impeller within a stator assembly is a well-accepted design. However, some inadequacies exist.

Aerators are normally manufactured as a single assembly. Alternatively, the motor and base portions may be manufactured separately. However, even with this approach, the base, stator assembly and diffuser tubes are manufactured as a single piece. Over time, the cutting or grinding action between the impeller and the inner wall of the stator assembly causes the stator itself to wear, negatively impacting overall operating efficiency. In fact, the requisite mixing and oxygen transfer can decrease dramatically. The apparent solution to this problem is to simply replace the worn stator. However, because of the singular design of the stator assembly, this is not possible. Replacement of the stator requires replacing the entire base assembly. From an economic standpoint, it is approximately the same expense to replace the base assembly as it is to replace the entire aerator.

An additional problem associated with the single base/stator assembly is that the stator cannot be manufactured to a different hardness than the remainder of the base without dramatically increasing costs. If the stator itself could be hardened during manufacture, the life of the device could be greatly increased. Even further, if the impeller were hardened along with the stator, the cutting ability of the aerator would be enhanced.

Finally, the diffuser tubes are all manufactured to a similar length. Thus, because the stator assembly usually is circular, the permanently attached diffuser tubes will cover a circular area. When the aerator is used within a circular basin, this design normally results in adequate aeration coverage. Conversely, when the floor of the basin is not circular, but instead is some other shape such as rectangular, the circular configuration of the diffuser tubes will not provide a complete coverage. Because of the permanent nature of the diffuser tubes, it is virtually impossible to provide complete coverage to a non-circular basin.

Aerators are effective tools for mixing and oxygenizing fluids maintained within a holding tank. However, current designs unnecessarily limit the life of an aerator due to the permanent nature of the stator. Therefore, a substantial need exists for an aerator incorporating a removable stator which can be hardened and designed to selectively receive separate diffuser tubes.

SUMMARY OF THE INVENTION

The present invention provides an aerator utilizing a removable stator. The aerator of the present invention is comprised of a submersible motor driving a rotatable shaft, an impeller, an upper ring, a removable stator, a lower ring, a frame, an inlet duct and an air supply source. The upper ring, the removable stator and the lower ring have aligned central openings, creating an aeration zone within which the impeller rotates.

The submersible motor is of a type commonly found in the industry. The impeller is attached to a lower end of the rotatable shaft. The upper ring is attached to the submersible motor and includes a central opening through which the rotatable shaft passes. The removable stator abuts a bottom face of the upper ring and has a central chamber sized to receive the impeller. The lower ring is selectively attached to the removable stator by way of a top surface which interfaces with a lower surface of the removable stator. To this end, the removable stator is configured to be readily removed from engagement with the upper ring and the lower ring. The frame is attached to the lower ring. The inlet duct is attached to the frame and the air supply source. More particularly, the inlet duct directs air from the air supply source to the aeration zone. In a preferred embodiment, the aerator further includes a plurality of diffuser tubes which are selectively attached to the removable stator.

The aerator of the present invention operates in a highly similar fashion to known designs. Following assembly, the aerator is submerged in a fluid to be aerated. This normally requires positioning the frame on the bottom surface of a basin maintaining the fluid. The air supply source is positioned to supply atmospheric air to the inlet duct. The submersible motor is activated, rapidly rotating the impeller within the aeration zone. This action aspirates atmospheric air down through the air supply source to the aeration zone by creating a low pressure area at the impeller. Air and surrounding fluid are then combined and discharged through the removable stator. The turbulence and flow created by the impeller breaks up the air bubbles, mixes fluid within the basin and disperses oxygen. The impeller and removable stator also act to grind and cut solids contained within the fluid.

The aerator of the present invention is designed to provide for simple replacement of the removable stator. To accomplish this, the submersible motor is detached from the upper ring. The removable stator is removed from engagement with the upper ring and the lower ring. A new removable stator is inserted and the entire assembly reconnected. In a preferred embodiment, the aerator further includes a plurality of diffuser tubes which are releasably attached to corresponding channels in the removable stator. Thus, the new removable stator is similarly designed for attachment to the diffuser tubes.

DETAILED DESCRIPTION OF THE PREFERRED EMBODIMENTS

Figure 1:
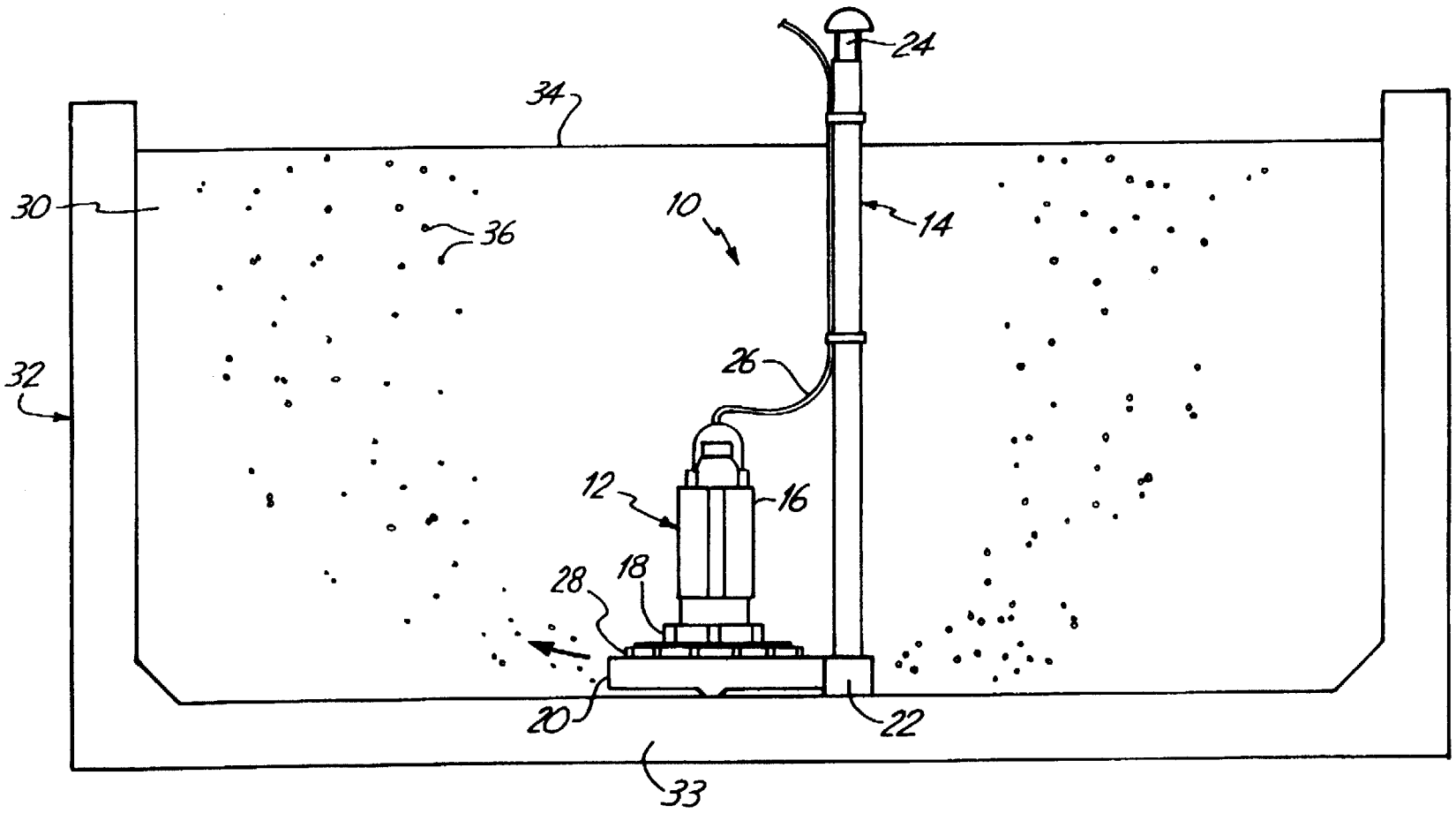
FIG. 1 is a side view of an aeration device of the present invention operating within a basin.

An aeration device 10 is shown in FIG. 1. The aeration device 10 includes an aerator 12 and an air inlet pipe 14. The aerator 12 includes a submersible motor 16, spacers 18 and a base 20.

The submersible motor 16 is releasably connected to the spacers 18, which in turn are connected to a portion of the base 20. The base 20 includes an inlet duct 22 which is attached to the air inlet pipe 14. At its upper end, the air inlet pipe 14 includes an intake area 24. The submersible motor 16 is attached to a power supply (not shown) by way of wiring 26. Finally, in a preferred embodiment, the base 20 includes diffuser tubes 28.

The aeration device 10 of the present invention is used to aerate a fluid 30 maintained within a basin 32. As will be described in greater detail below, the base 20 encloses an aeration zone (not shown) within which an impeller (not shown) rotates. The aeration device 10 is positioned within the basin 32 such that the base 20 rests on a bottom wall 33 of the basin 32. The air inlet pipe 14 is designed to have a length such that the intake area 24 is above a top surface 34 of the fluid 30.

Once positioned within the basin 32, the submersible motor 16 is activated via an electrical current through the wiring 26. The aerator 12 aspirates atmospheric air down the air inlet pipe 14 by creating a low pressure zone at the impeller (not shown) within the base 20. Air and the fluid 30 are combined and discharged through the diffuser tubes 28. As shown by the directional arrow in FIG. 1, a mixture of air and fluid is propelled from the diffuser tubes 28 into the fluid 30. Further, air bubbles 36 are formed, transferring oxygen into the fluid 30.

Figure 2:
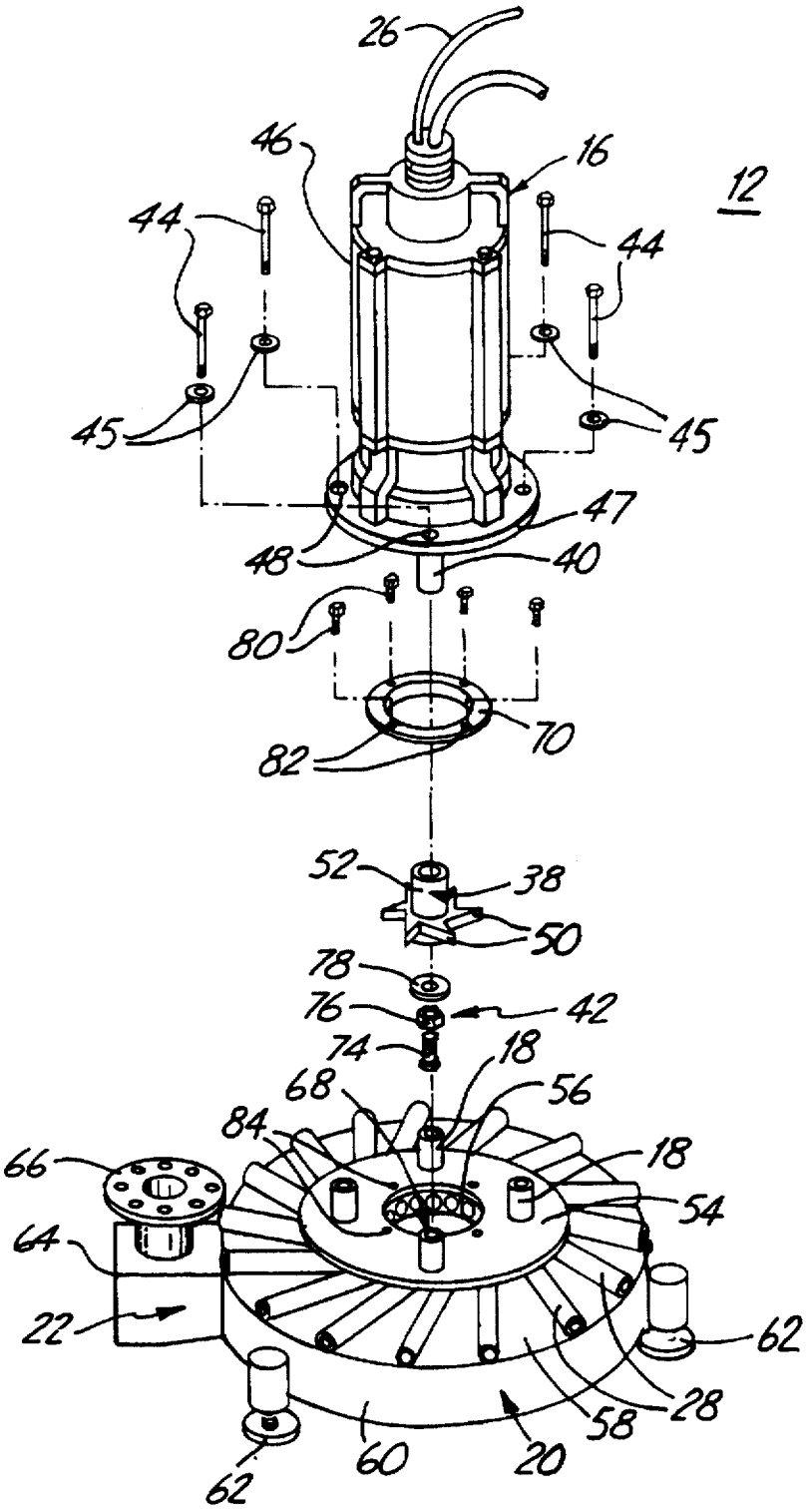
FIG. 2 is an exploded view of the aerator in accordance with the present invention.

A more detailed representation of the aerator 12 is provided by the exploded view shown in FIG. 2. The aerator 12 includes the submersible motor 16, an impeller 38 and the base 20. The impeller 38 is attached to a drive shaft 40 of the submersible motor 16 by an impeller attachment means 42. The submersible motor 16 is releasably attached to the spacers 18 of the base 20 by a motor attachment means such as a plurality of bolts 44 and lock washers 45.

The submersible motor 16 includes the wiring 26, the drive shaft 40 and an outer casing 46. The outer casing 46 has a flange 47 which includes a plurality of bolt receiving passages 48 sized to receive one of the plurality of bolts 44. Basically, the submersible motor 16 is of a type commonly known in the industry. Thus, the submersible motor 16 can have a power capability ranging from 2 to 100 horsepower (1.5 to 74.6 kilowatts).

The impeller 38 includes a plurality of vanes 50 extending from a hub 52. While the impeller 38 is shown in FIG. 2 as having six of the vanes 50, any other number, such as four, five or eight, is equally acceptable.

The base 20 includes the spacers 18, an upper ring 54, a removable stator 56 (shown partially in FIG. 2), the diffuser tubes 28, a lower ring 58, a frame 60, adjustable feet 62 and the inlet duct 22. The inlet duct 22 includes a horizontal conduit 64 and a receiving member 66 which is attached to the air inlet pipe (not shown). Further details on construction of the base 20 are provided below. However, it should be noted that an aeration zone 68 is centrally formed in the base 20. More particularly, the upper ring 54, the removable stator 56 and the lower ring 58 have aligned, central openings or chambers which form the aeration zone 68.

The aerator 12 is assembled by attaching the impeller 38 to the drive shaft 40. In a preferred embodiment, a retaining ring 70, having an inner diameter which is smaller than the outer diameter of the vanes 50 of the impeller 38, is first placed centrally around the drive shaft 40. The impeller 38 is then connected to the drive shaft 40 by inserting the hub 52 on to the drive shaft 40. The impeller attachment means 42, which in a preferred embodiment includes a bolt 74, a lock washer 76 and a washer 78, secures the impeller 38 to the drive shaft 40.

The submersible motor 16 is then positioned on the base 20 such that the impeller 38 extends into the aeration zone 68 and the bolt receiving passages 48 of the flange 47 align with the spacers 18. The motor attachment means 44, 45 releasably secures the submersible motor 16 to the base 20. More particularly, one of the plurality of bolts 44 is passed through one of the lock washers 45 and then through one of the plurality of bolt receiving passages 48 in the flange 47 and attached to a corresponding one of the spacers 18. Thus, in the preferred embodiment, the spacers 18 have a threaded inner diameter for receiving one of the plurality of bolts 44.

The retaining ring 70 is attached to the upper ring 54 by way of retaining bolts 80, encompassing the impeller 38 within the aeration zone 68. The upper ring 54 includes openings 84 to assist in securing the retaining ring 70. More particularly, one of the retaining bolts 80 is passed through one of the openings 82 in the retaining ring 70 and secured to one of the openings 84 in the upper ring 54. Thus, the openings 84 are threaded. Further, the retaining ring 70 has an outer diameter which is less than a diameter of a circle formed by the spacers 18 so that the retaining ring 70 abuts a top surface of the upper ring 54.

Figure 3:
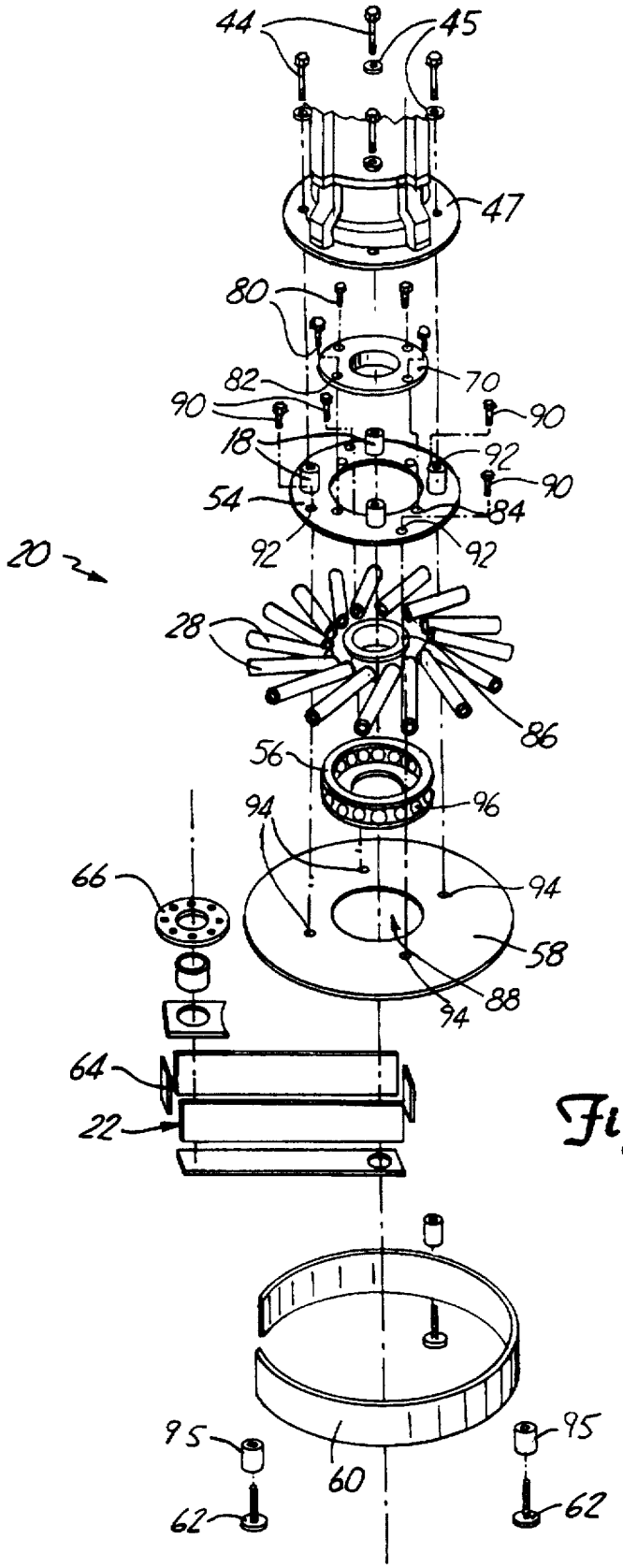
FIG. 3 is an exploded view of the base portion including a removable stator in accordance with the present invention.

FIG. 3 provides further details of the base 20. The base 20 includes the spacers 18, the upper ring 54, the diffuser tubes 28, a bushing 86, the removable stator 56, the lower ring 58, the inlet duct 22, the frame 60 and the adjustable feet 62. To better illustrate attachment of various components, FIG. 3 also includes the submersible motor 16 (shown partially in FIG. 3), the motor attachment means 44, 45, along with the retaining ring 70 and the retaining bolts 80.

The spacers 18 are welded to a top surface of the upper ring 54. The removable stator 56, as described in greater detail below, is sized to rest on an upper surface of the lower ring 58. Further, the lower ring 58 includes a central opening 88 which receives a flanged portion (not shown) of the removable stator 56. The bushing 86, which in the preferred embodiment is bronze, is sized to be press fitted within the flanged portion of the removable stator 56. The upper ring 54 is placed on top of the removable stator 56 such that central openings of the upper ring 54, the removable stator 56 and the lower ring 58 are aligned. As described in more detail below, the removable stator 56 has lips on its upper and lower surfaces for securely interfacing the upper ring 54 and the lower ring 58. Finally, the upper ring 54, the removable stator 56 and the lower ring 58 are releasably connected by a stator attachment means, which in the preferred embodiment includes retaining bolts 90.

More particularly, the upper ring 54 has bolt receiving openings 92. Similarly, the lower ring 58 includes threaded bolt securing openings 94. Each one of the retaining bolts 90 is passed through one of the bolt receiving openings 92 in the upper ring 54 and secured to one of the threaded bolt securing openings 94 in the lower ring 58. Notably, a bolt circle formed by the bolt receiving openings 92 and the bolt securing openings 94 is of a larger diameter than the removable stator 56. Thus, the retaining bolts 90 pass by the removable stator 56. Once connected, the retaining bolts 90 releasably secure or clamp the removable stator 56 between the upper ring 54 and the lower ring 58.

Other means of securing the removable stator 56 are equally acceptable, such as attaching, via bolts, the upper ring 54 to the removable stator 56 and securing the removable stator 56 to the lower ring 58 by a frictional fit.

The removable stator 56 includes channels 96 which are sized to receive the diffuser tubes 28. As shown in greater detail below, each of the channels 96 is tapped at an outer portion of the removable stator 56. Each of the diffuser tubes 28 has a correspondingly threaded end. With this configuration, the threaded end of one of the diffuser tubes 28 is simply screwed into the channels 96. Alternatively, the channels 96 can be designed to be of varying diameter so that the diffuser tubes 28 are frictionally maintained.

The frame 60 is comprised of a formable material, preferably stainless steel, and is wrapped about the circumference of the lower ring 58. In the preferred embodiment, the frame 60 is welded to the lower ring 58. The inlet duct 22 is positioned beneath the lower ring 58 such that a portion of the horizontal conduit 64 is aligned with the central opening 88 of the lower ring 58 therby placing inlet duct 22 in communication with aeration zone 68 upon assembly. Further, a second portion of the horizontal conduit 64, including the receiving member 66, extends outwardly from the frame 60. Finally, the adjustable feet 62 are welded to the frame 60 via tubes 95. During operation, the rotation of impeller 38 creates low pressure within aeration zone 68 thereby drawing air from inlet duct 22 into aeration zone 68. Simultaneously, fluid 30 is drawn into top of aeration zone 68 through the gap between flange 47 and upper ring 54 which is maintained by spacers 18. Fluid 30 is also drawn into bottom of aeration zone 68 through the orifice and inlet duct 22. Fluid 30 mixes with air to form air bubbles which are then forced out of aeration zone 68 by impeller 38 into removable stator 56.

Figure 4A:
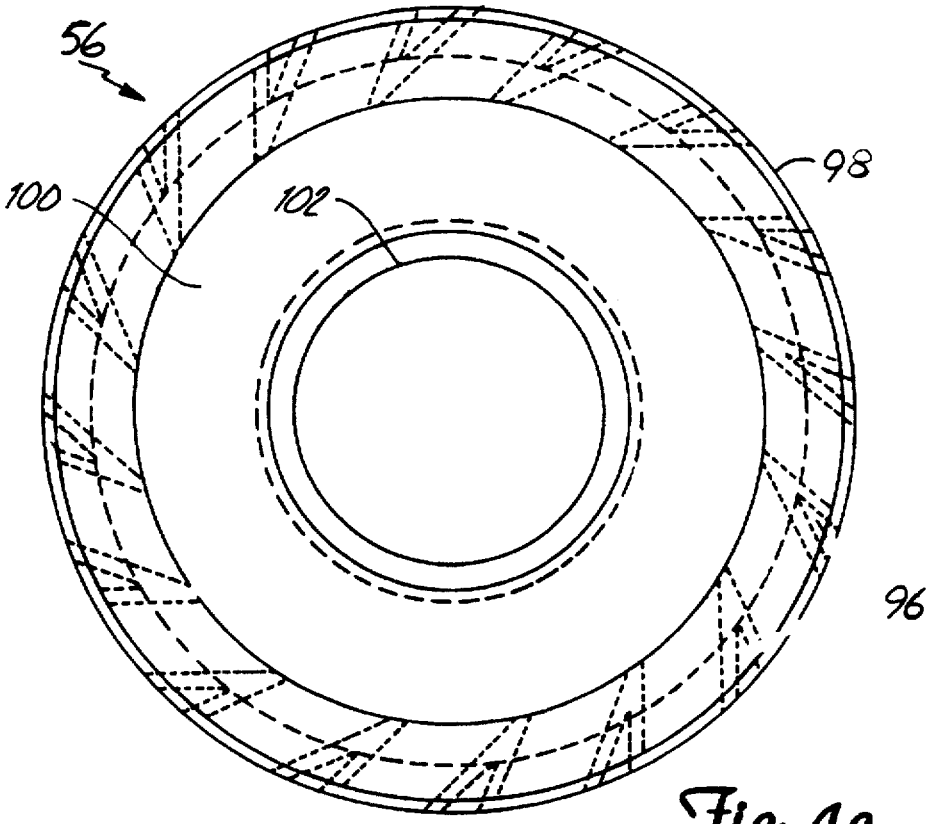
FIG. 4*a* is a top view of the removable stator in accordance with the present invention.
Figure 4B:
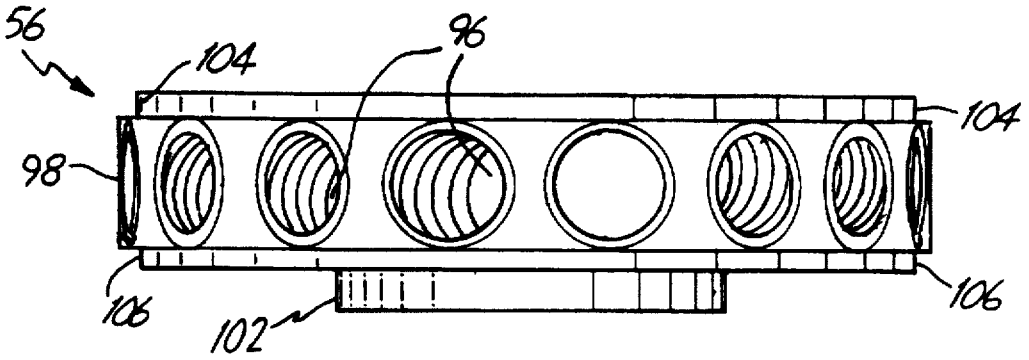
FIG. 4*b* is a side view of the removable stator in accordance with the present invention.

The removable stator 56 is shown in greater detail in FIGS. 4*a* and 4*b*. The removable stator 56 includes a side wall 98, a bottom plate 100 and a flange 102. The bottom plate 100 is attached to the side wall 98. The flange 102 extends downwardly from the bottom plate 100.

The side wall 98 includes a top lip 104, the channels 96 and a bottom lip 106. As previously described, the channels 96 are tapped to receive a threaded portion of one of the diffuser tubes (28 in FIG. 3). The preferred embodiment includes sixteen of the channels 96, although any other number is equally acceptable. The top lip 104 is sized to receive the upper ring (54 in FIG. 3) In other words, the diameter of the top lip 104 matches an inner diameter of the upper ring (54 in FIG. 3). Similarly, the bottom lip 106 is sized to receive the lower ring (58 in FIG. 3). Thus, the top lip 104 and the bottom lip 106 ensure that the removable stator 56, the upper ring (54 in FIG. 3) and the lower ring (58 in FIG. 3) are concentrically aligned.

The flange 102 is circular in shape and extends downwardly from the side wall 98. The side wall 98, the bottom plate 100 and the flange 102 have aligned, central openings which form a central chamber. Further, the flange 102 is sized to receive the bushing (86 in FIG. 3) which is press fitted and fictionally maintained within the flange 102. Notably, while the preferred removable stator 56 includes the flange 102, the flange 102 is not a required element. The removable stator 56 can still be removably maintained within the base (20 in FIG. 2), and the aerator (12 in FIG. 2) can still function without the flange 102 or the bushing (86 in FIG. 3).

The removable stator 56 is preferably constructed of strong, wear resistant metal. In a preferred embodiment, the removable stator 56 is heat treated to a Rockwell hardness of at least 44C. With this form of manufacturing, the removable stator 56 has an extended life. Further, because the removable stator 56 is machined separately from other components, the costs associated with providing a heat treated stator are low. Finally, the impeller (38 in FIG. 2) can also be heat treated, further improving longevity and performance.

Returning to FIGS. 2 and 3, during use the aerator 12 of the present invention functions similar to other submersible aerators. Basically, once submerged, the submersible motor 16 rotates the impeller 38 within the aeration zone 68. Over time, due to interaction with particulates contained within the fluid being aerated, the removable stator 56 will begin to wear. This wearing deteriorates the effectiveness of the aerator 12. To replace the removable stator 56, the submersible motor 16 is detached from the spacers 18 by unfastening the motor attachment means 44, 45 and disconnecting the retaining ring 70 from the upper ring 54 by unscrewing the retaining bolts 80.

The stator attachment means is then released by disconnecting the retaining bolts 90. The upper ring 54 is disconnected from the lower ring 58, exposing the removable stator 56. The diffuser tubes 28 are detached or unscrewed from engagement with the channels 96 of the removable stator 56. Subsequently, the worn removable stator 56 is lifted from the lower ring 58. The bushing 86 is displaced from the removable stator 56.

The bushing 86 is pressed into a new removable stator 56, which is then placed into engagement with the lower ring 58. The diffuser tubes 28 are attached to the channels 96. The upper ring 54 is placed onto the removable stator 56 such that the upper ring 54 rests on the top lip (104 in FIG. 4*b*). The removable stator 56 is releasably secured or clamped between the upper ring 54 and the lower ring 58 by the retaining bolts 90. The submersible motor 16 is attached to the upper ring 54 by the motor attachment means 44, 45. Finally, the retaining ring 70 is secured to the upper ring 54.

The aerator 12 of the present invention is uniquely designed to provide for simple replacement of the removable stator 56. Unlike previous aerators, the removable stator 56 of the present invention can be manufactured separately from the base 20, thus allowing for a more durable, yet inexpensive, construction. Further, the removable stator 56 is easily replaced, requiring only the detachment of the motor attachment means 44, 45 and the stator attachment means. Notably, the aerator 12 can be designed so that a single attachment means releasably connects the submersible motor 16, the upper ring 54, the removable stator 56 and the lower ring 58. For example, one set of bolts can be used.

By providing for simple assembly and disassembly, the aerator 12 of the present invention has an additional attribute of possible connection to other aerators. As previously described, the removable stator 56 includes the channels (96 in FIGS. 4*a* and 4*b*) which are sized to receive and selectively maintain the diffuser tubes 28. Thus, the diffuser tubes 28 are easily attached to and removed from the removable stator 56. With an appropriately sized diffuser tube 28, the removable stator 56, and therefore the aerator 12, can be connected to another aerator/stator, increasing the aeration effect. In other words, a single diffuser tube 28, both ends of which are threaded, can be connected to two separate aerators.

Figure 5:
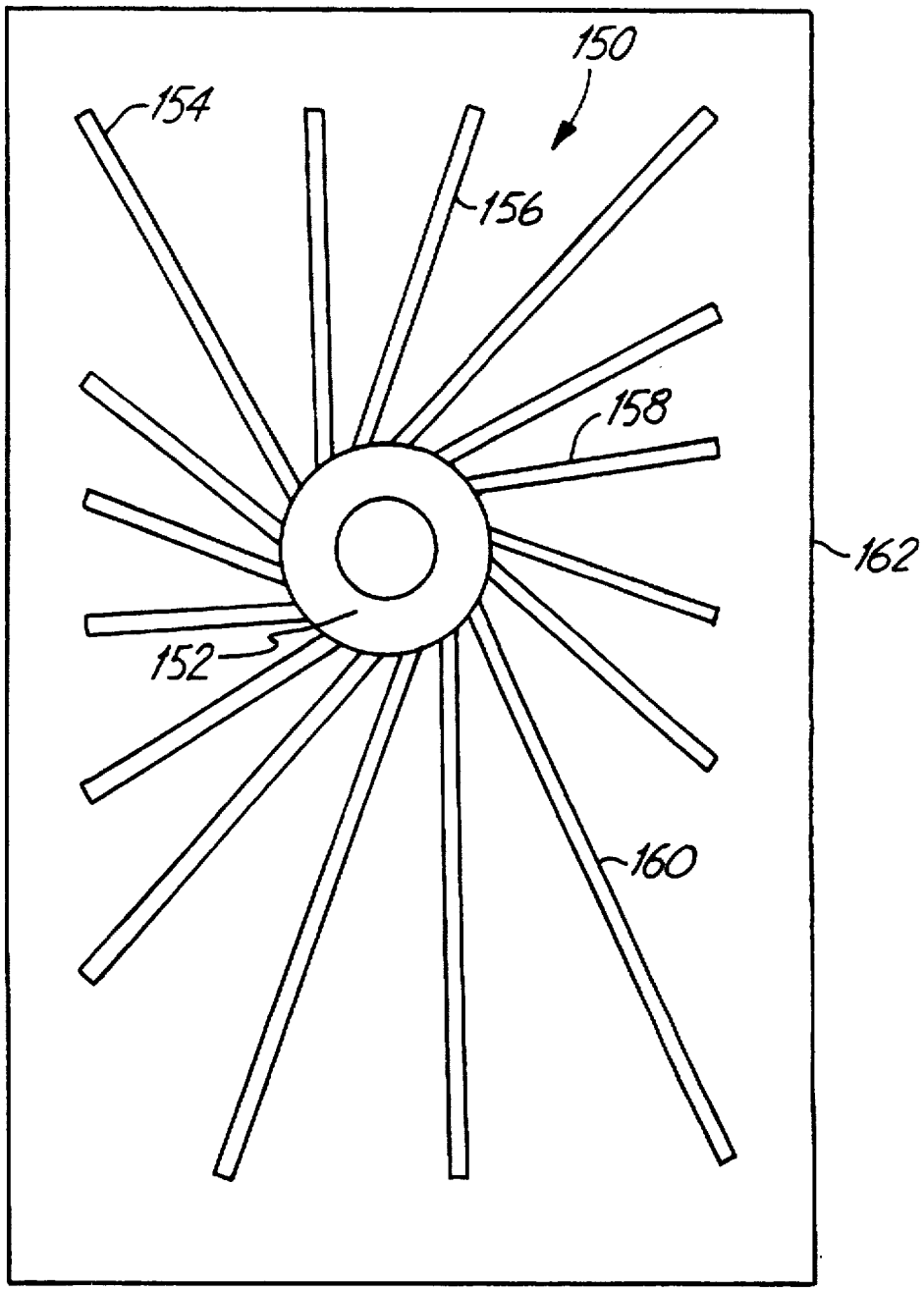
FIG. 5 is a top, schematic view of an aerator having diffuser tubes of varying lengths operating within a basin.

Even further, the aerator 12 can be provided with diffuser tubes 28 of varying lengths. As shown in the alternative embodiment of FIG. 5, an aerator 150 can include a submersible motor 152 from which a number of diffuser tubes 154–160 extend. The length of each individual diffuser tube 154, 156, 158 or 160 is selected based upon the dimensions of a basin 162 within which the aerator 150 operates. Thus, where the basin 162 is rectangular, the diffuser tubes 154–160 are selected and positioned to cover a more rectangular area (versus the circular distribution shown in FIG. 3, for example). So, some of the diffuser tubes 154 and 160 (for example) would be longer than other of the diffuser tubes 156 and 158 (for example). This approach carries the aerated water and mixing action produced by the aerator 150 to walls of the basin 162, in all directions. Because, as previously described, the removable stator (56 in FIGS. 4*a* & 4*b*) is provided with the tapped channels (96 in FIGS. 4*a* & 4*b*), the diffuser tubes 154–160 can easily be replaced with diffuser tubes of different lengths. Thus, depending upon the dimensions of the particular basin 162, the aerator 150 can be fitted with the diffuser tubes 154–160 of appropriate length.

Although the present invention has been described with reference to preferred embodiments, workers skilled in the art will recognize that changes may be made in form and detail without departing from the spirit and scope of the invention. For example, the aerator need not incorporate all of the components described in the preferred embodiment. In fact, the present invention encompasses any type of aerator having a base with a removable stator which can be readily replaced. Thus, the diffuser tubes are not required. Likewise, the retaining ring and bushing are not required.

The motor attachment means has been preferably described as including four bolts and associated lock washers. However, any other number of bolts is equally acceptable. Additionally, the motor attachment means can be comprised of pins, a flexible lip, a frictional fit, or other designs.

The removable stator can be secured within the base by any of a number of approaches. The removable stator can be captured between the upper ring and the lower ring, which in turn are attached to one another. Or, the removable stator can have bolt receiving openings through which bolts connect the upper ring, removable stator and the lower ring. Alternatively, the removable stator can be independently secured to both the upper ring and the lower ring by bolts, pins, frictional fit, etc.

What is claimed is:

1. A device for aerating liquids, the device comprising:

a submersible motor driving a rotatable shaft, the submersible motor having an outer casing;

an impeller attached to a lower end of the rotatable shaft;

an upper ring connected to a portion of the outer casing, the upper ring having a first central opening through which the rotatable shaft passes;

a motor attachment means for releasably connecting the submersible motor and the upper ring:

a removable stator having an upper lip, a lower lip, and a central chamber for receiving the impeller, the removable stator abutting a bottom face of the upper ring such that the upper lip mates with the first central opening of the upper ring, the removable stator having a cylindrical side wall which includes a plurality of channels and which defines a central chamber for receiving the impeller;

a lower ring having a top surface, a bottom surface, and a second central opening, the lower ring engaging the removable stator such that the lower lip of the removable stator mates with the second central opening of the lower ring, wherein the removable stator is an integral unit configured to be readily removed as a single piece from engagement with the upper ring and the lower ring;

means for releasably connecting the upper ring and the lower ring so that the removable stator is held securely between the upper ring and the lower ring; a frame attached to the bottom surface of the lower ring; and an inlet duct attached to the frame for directing air to the frame from an air supply source.

2. The device of claim 1 wherein the removable stator is heat treated to a Rockwell hardness of at least 44C.

3. The device of claim 1 wherein the removable stator has a side wall which includes a plurality of channels, the device further comprising:

a plurality of diffuser tubes, wherein each of the plurality of diffuser tubes is releasably attached to and extends from one of the plurality of channels in the removable stator.

4. The device of claim 3 wherein each of the plurality of channels includes a tapped portion for securing a threaded end of one of the plurality of diffuser tubes.

5. The device of claim 1 wherein the means for releasably connecting includes a plurality of retaining bolts.

6. The device of claim 5 wherein the stator attachment means further includes a plurality of bolt receiving openings in the upper ring for receiving the plurality of retaining bolts and a plurality of threaded bolt holes in the lower ring for securing the plurality of retaining bolts.

7. The device of claim 6 wherein the plurality of bolt receiving openings in the upper ring form a bolt circle having a diameter which is larger than an outer diameter of the removable stator.

8. The device of claim 1 wherein the removable stator comprises:

a side wall having a plurality of channels; and a flange extending downwardly from a bottom portion of the side wall.

9. The device of claim 8 further comprising a bushing sized to fit within the flange.

10. An improved aerator including an impeller rotationally driven by a submersible motor, the motor having an external casing attached to an upper ring which forms a part of an aeration zone within which the impeller rotates, a frame and an air inlet connected to the frame for supplying air to the aeration zone, the improvement comprising:

a removable stator located in the aeration zone, the removable stator being releasably connected to the upper ring, wherein the removable stator includes a cylindrical side wall having a plurality of circumferentially spaced channels and defines a central chamber for receiving the impeller and is removable as an integral unit;

a lower ring releasably connected to the upper ring and fixed to the frame, wherein the removable stator is securely held between the upper ring and the lower ring; and a plurality of diffuser tubes for directing air and water from the aeration zone, wherein one of the plurality of diffuser tubes is releasable connected to and extends from one of the plurality of channels in the removable stator.

11. The device of claim 10, wherein the removable stator comprises:

a side wall; and a flange extending downwardly from a bottom portion of the side wall.

12. The device of claim 10, wherein the improvement further comprises:

stator attachment means for securing the removable stator within the aeration zone, wherein the stator attachment means is configured to allow the removable stator to be readily removed from the aeration zone.

13. The device of claim 12 wherein the stator attachment means includes a plurality of bolts.

14. A removable stator for use with an aerator including a submersible motor driving an impeller, a base having an upper ring with a first inner diameter, and a lower ring with a second inner diameter supporting the motor, the base having an aeration zone in which the impeller rotates, an air intake by which air is introduced into the aeration zone, and diffuser tubes for directing flow from the stator, the removable stator comprising:

a cylinder defined by a circular side wall having a plurality of circumferentially spaced channels, each channel tapped for receiving a threaded end of a diffuser tube, the circular side wall having an upper lip sized to fit the first inner diameter of the upper ring and a lower lip sized to fit the second inner diameter of the lower ring; and a central opening formed by the circular side wall, the central opening sized to receive the impeller.

15. The removable stator of claim 14 further comprising:

a bottom plate attached to a lower portion of the circular side wall, the bottom plate defining a first central opening; and a flange extending downwardly from the bottom plate, the flange defining a second central opening, wherein the first central opening and the second central opening are aligned to create a lower passage for receiving air from the air intake.

16. The removable stator of claim 14, wherein each of the plurality of channels has a tapped portion for receiving a threaded end of a diffuser tube.

17. A method for repairing an aeration device, the aeration device including a submersible motor attached to a base, wherein the base includes an upper ring, a worn stator and a lower ring; the upper ring, the worn stator and the lower ring being releasably connected by a stator attachment means, the method including:

releasing the submersible motor from the base;

disconnecting the stator attachment means;

removing the upper ring;

replacing the worn stator with a new stator;

positioning the upper ring above the new stator;

connecting the stator attachment means to secure the new stator between the upper ring and the lower ring; and securing the submersible motor to the base.

18. An improved aerator including an impeller rotationally driven by a submersible motor, the motor having an external casing attached to a stator assembly including an aeration zone within which the impeller rotates, a frame and an air inlet connected to the frame for supplying air to the aeration zone, the improvement comprising:

a plurality of channels located on an outer circumference of the stator assembly for distributing a mixture of liquid and air from the aeration zone, wherein each of the channels includes a tapped portion; and a plurality of diffuser tubes, wherein each of the plurality of diffuser tubes includes a threaded end such that the threaded end of one of the plurality of diffuser tubes releasably engages the tapped portion of one of the plurality of channels and the plurality of diffuser tubes are of varying lengths for distributing the mixture of liquid and air evenly across the basin.

* * * * *